US005328071A

United States Patent [19]

Aihara

[11] Patent Number: 5,328,071

[45] Date of Patent: Jul. 12, 1994

[54] ROLL PAPER CUTTING APPARATUS

[75] Inventor: Ryoji Aihara, Yokohama, Japan

[73] Assignee: Matsushita Electric Industrial Co., Ltd., Osaka, Japan

[21] Appl. No.: 967,441

[22] Filed: Oct. 28, 1992

[30] Foreign Application Priority Data

Nov. 14, 1991 [JP] Japan ..... 3-298709

[51] Int. Cl.[5] ..... B26D 1/02; B41J 11/70; B65D 85/671

[52] U.S. Cl. ..... 225/91; 225/77

[58] Field of Search ..... 225/91, 77

[56] References Cited

U.S. PATENT DOCUMENTS

| | | | |
|---|---|---|---|
| 2,693,237 | 11/1954 | Zinn et al. | 225/91 |
| 3,088,640 | 5/1963 | Kunsch | 225/91 |
| 4,426,029 | 1/1984 | Kamp | 225/49 |
| 4,458,570 | 7/1984 | Morrison | 225/91 |
| 4,506,816 | 3/1985 | Roccaforte | 225/91 |
| 4,579,267 | 4/1986 | Planke | 225/91 |
| 5,078,311 | 1/1992 | Taguchi et al. | 225/91 |

FOREIGN PATENT DOCUMENTS 2618007 11/1977 Fed. Rep. of Germany ..... 225/77

*Primary Examiner*—Hien H. Phan

*Attorney, Agent, or Firm*—Stevens, Davis, Miller & Mosher

[57] ABSTRACT

A roll paper cutting apparatus in a printer whereby printed roll paper which has been printed and released can be cut certainly and smoothly with a simple structure. For this purpose, this roll paper cutting apparatus has a paper cutter comprising bite teeth which are provided on at least one of end portions thereof so as to start to cut released roll paper when it is held by an operator's hand, and cut teeth which are provided on a region different from a region of the bite teeth, the bite teeth and the cut teeth being located along a straight line, wherein the bite teeth are formed in such a manner that an angle between a line perpendicular to a row of the cut teeth and an outside surface contour line of each of the bite teeth is smaller than an angle between an inside surface contour line of the tooth on the other side and the perpendicular line. Preferably, the bite teeth have smaller pitches than the cut teeth.

2 Claims, 3 Drawing Sheets

ROLL PAPER CUTTING APPARATUS

BACKGROUND OF THE INVENTION

1. Industrial Field of the Invention

The present invention relates to a roll paper cutting apparatus for a small-sized facsimile terminal unit for domestic use, a small-sized electronic calculator (desk calculator) with a printer, or the like.

2. Description of the Prior Art

FIG. 5 illustrates a cutting section of a roll paper cutting apparatus provided in a conventional small-sized facsimile terminal unit for domestic use or a small-sized electronic calculator (desk calculator) with a printer. In FIG. 5, reference numeral 31 denotes a paper cutter, and 32 denotes roll paper which has been printed at a printing section (not shown) and released. The paper cutter 31 has uniform teeth of an angular shape, as shown in the drawing, or a similar shape, which are continuously formed along a straight line.

Next, the function of this structure will be explained.

The roll paper 32 can be cut by contacting the roll paper 32 with teeth of the paper cutter 31 at a position [R], and continuing to draw the roll paper 32 in a direction indicated by the arrow A. The roll paper 32 can be cut similarly by drawing it in a direction indicated by the arrow B.

However, the conventional roll paper cutting apparatus has a problem that when the roll paper 32 is brought into contact with the teeth of the paper cutter 31 at the position [R] and the roll paper 32 is drawn in the direction of the arrow A, the roll paper 32 slides on the teeth of the paper cutter 31 at the beginning of cutting operation of the roll paper 32 so that the roll paper 32 can not be cut quickly.

The roll paper 32 can be easily cut, if cutting operation is started with a small angle [$\alpha$] between the roll paper 32 and the teeth of the paper cutter 31. However, there is another problem with this approach in that the roll paper 32 will not be easily bitten at the beginning of cutting operation so that it can not be cut without difficulty.

SUMMARY OF THE INVENTION

The present invention has been achieved to solve the above-described problems. An object of the present invention is to provide a printer including an excellent roll paper cutting apparatus whereby printed roll paper, which has been released, can be cut certainly and smoothly with a simple structure.

In order to attain this object, a roll paper cutting apparatus according to the invention has a paper cutter comprising bite teeth which are provided on at least one end portions thereof so as to start to cut released roll paper when it is held by an operator's hand, and cut teeth which are provided on a region different from a region of the bite teeth, the bite teeth and the-cut teeth being located along a straight line, wherein the bite teeth are formed in such a manner that an angle between a line perpendicular to a row of the cut teeth and an outside surface contour line of each of the bite teeth is smaller than an angle between an inside surface contour line of the tooth on the other side and the perpendicular line.

Further, the bite teeth of the paper cutter have smaller pitches than the cut teeth.

In the roll paper cutting apparatus according to the invention, the bite teeth are formed in such a manner that the angle between the line perpendicular to the row of teeth and an outside surface contour line of the tooth is smaller than the angle between that perpendicular line and the inside surface contour line of the tooth on the other side, or that the bite teeth have smaller pitches than the cut teeth, so that they will bite into the released roll paper favorably at the beginning of cutting operation, which leads to the effect that the printed roll paper which has been printed and released can be cut certainly and smoothly with a simple structure.

DETAILED DESCRIPTION OF THE INVENTION

The preferred embodiments of roll paper cutting apparatus according to the present invention will be hereinafter described with reference to the attached drawings.

Figure 1:
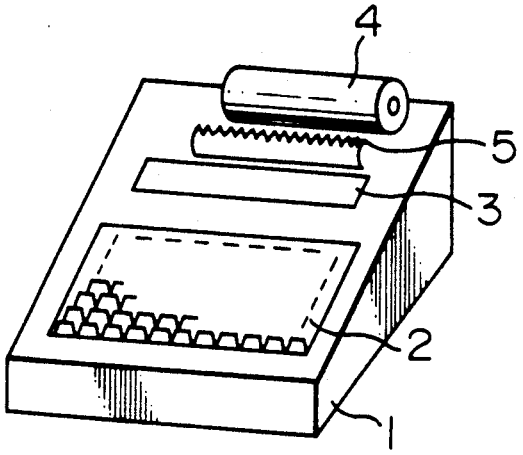
FIG. 1 is a perspective view showing an outer-appearance of a structure of a small-sized electronic calculator (desk calculator) with a printer incorporated with a first embodiment of a roll paper cutting apparatus according to the present invention.

FIG. 1 shows an external appearance of a small-sized electronic calculator (desk calculator) with a printer in a first embodiment of the invention. In FIG. 1, reference numeral 1 denotes a casing, 2 denotes a keyboard provided on an upper portion of the casing 1, 3 denotes a display section, 4 denotes roll paper, and 5 denotes a released roll paper cutting section for cutting the roll paper 4 which has been printed and released.

Figure 2:
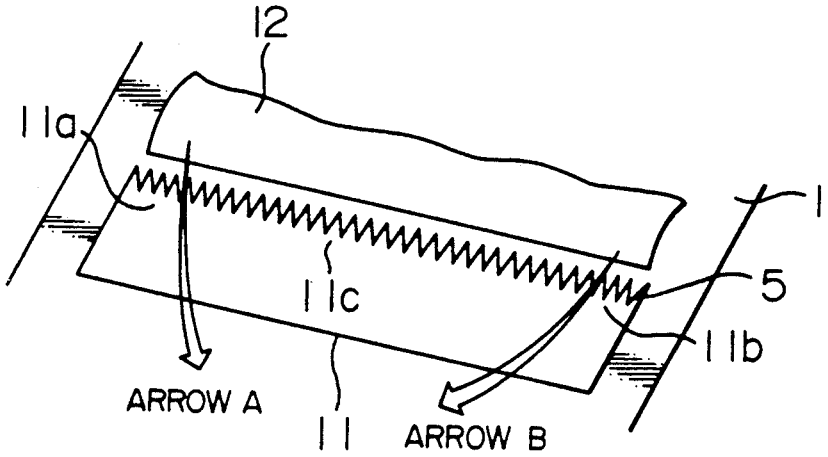
FIG. 2 is a perspective view showing a structure of a released roll paper cutting section of the first embodiment.
Figure 3:
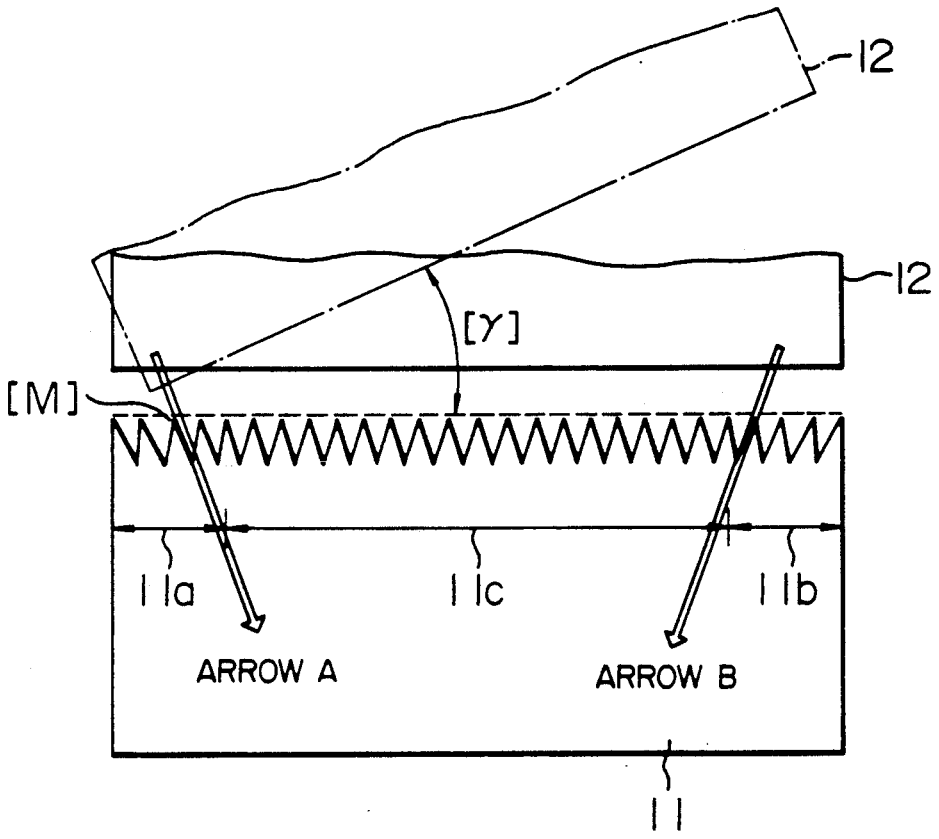
FIG. 3 is an enlarged plan view of the structure of the released roll paper cutting section shown in FIG. 2.

FIG. 2 illustrates the released roll paper cutting section 5 of the first embodiment shown in FIG. 1, and FIG. 3 is an enlarged view of this released roll paper cutting section 5. In FIGS. 2 and 3, reference numeral 11 denotes a paper cutter, and 12 denotes printed roll paper which has been printed and released. The paper cutter 11 comprises bite teeth 11*a* and 11*b* provided on both end portions thereof, and cut teeth 11*c* located between these bite teeth 11*a* and 11*b*. Each set of the bite teeth 11*a*, 11*b* is formed in such a manner that an angle between a line perpendicular to a row of teeth indicated by a dotted line and an outside surface contour line of the tooth is smaller than an angle between that perpendicular line and an inside surface contour line of the tooth on the other side, and the bite teeth 11*a*, 11*b* are inclined toward the respective ends. The cut teeth 11*c* have a conventional triangular shape.

Next, the function of this structure will be explained.

Referring to FIG. 3, in order to cut the printed roll paper 12, an operator holds, with his hand, a central portion or a left end portion of the printed roll paper 12 which has been printed and released, brings an end portion of the printed roll paper 12 into contact with the paper cutter 11, and continues to draw the printed roll paper 12 in a direction indicated by the arrow A. Alternatively, an operator holds a central portion or a right end portion of the printed roll paper 12, brings the roll paper 12 into contact with the paper cutter 11, and continues to draw the printed roll paper 12 in a direction indicated by the arrow B.

In this specification, the case where the printed roll paper 12 is drawn in the direction of the arrow A will be described in detail.

The paper cutter 11 bites into the printed roll paper 12 drawn in the direction of the arrow A, at a position [M] shown in FIG. 3. Then, as the operator continues to draw the printed roll paper 12, the printed roll paper 12 is cut from the left end by the bite teeth 11*a*, the cut teeth 11*c* and the bite teeth 11*b* successively.

In this case, even if the printed roll paper 12 is contacted with the paper cutter 11 at a small angle [$\gamma$] from the row of teeth indicated by the dotted line, the bite teeth 11*a* provided at the endseasily bite into the printed roll paper 12 so that the rest of the paper will be easily cut by the cut teeth 11*c* and the bite teeth 11*b*. In the case where the printed roll paper 12 is drawn in the direction of the arrow B, the bite teeth 11*b* easily bite into the printed roll paper 12 in substantially the same manner as the case where the printed roll paper 12 is drawn in the direction of the arrow A, so that the rest of the paper will be easily cut.

Figure 4:
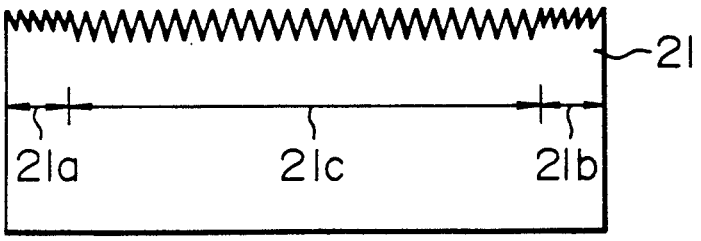
FIG. 4 is a plan view of a structure of a paper cutter in a second embodiment of the invention.
Figure 5:
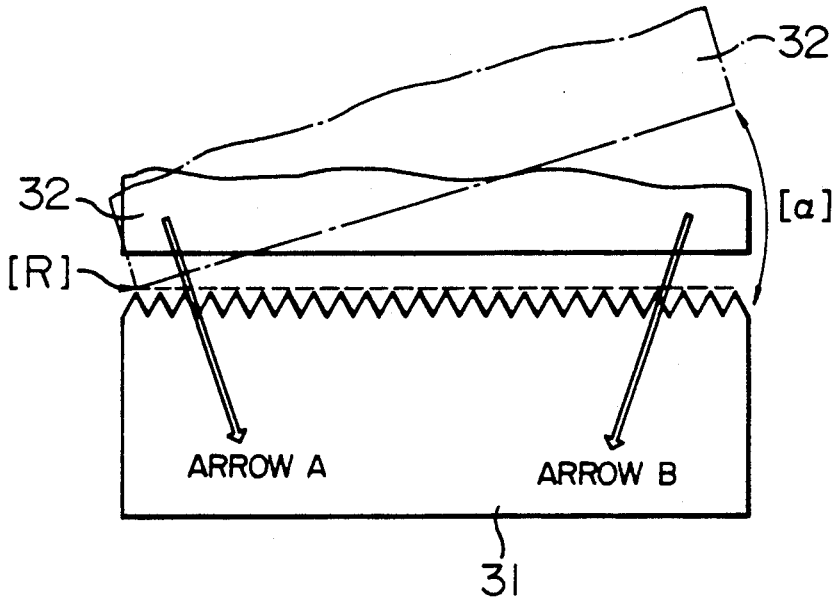
FIG. 5 PRIOR ART
FIG. 5 is a plan view of a structure of a conventional released roll paper cutting section.

FIG. 4 illustrates a second embodiment of a paper cutter 21 which is different from the paper cutter 11 of the first embodiment in respect of the configuration of the bite teeth 11*a*, 11*b*. Referring to FIG. 4, the paper cutter 21 comprises bite teeth 21*a*, 21*b* at both end portions thereof which have substantially the same angles as the bite teeth 11*a*, 11*b* of the paper cutter 11, but have smaller pitches. Cut teeth 21*c* have substantially the same shape as the cut teeth 11*c* of the paper cutter 11.

In this case, the bite teeth 21*a* bite into the printed roll paper 12 more favorably, to thereby make cutting operation even easier than by the above-described paper cutter 11.

In the roll paper cutting apparatus according to the present invention, as obviously understood from the above description, each set of the bite teeth is formed in such a manner that the angle between the line perpendicular to the row of teeth and the outside surface contour line of the tooth is smaller than the angle between that perpendicular line and the inside surface contour line of the tooth on the other side, or that the bite teeth have smaller pitches than the cut teeth, so that they will bite into the released roll paper more easily at the beginning of cutting operation, which leads to the effect that the printed roll paper which has been printed and released can be cut certainly and smoothly with a simple structure.

What is claimed is:

1. A roll paper cutting apparatus comprising:

a paper cutter having a cutting surface;

at least one bite tooth, having a first geometric shape, disposed on at least one end portion of said cutting surface; and a plurality of cut teeth, each of said cut teeth having a second geometric shape which is different from said first geometric shape, said plurality of cut teeth being disposed only on a region of said cutting surface distinct from said at least one end portion on which said at least one bite tooth is disposed, none of said cut teeth being located on said at least one end portion of said cutting surface, said at least one bite tooth and said cut teeth being located along a straight line, wherein:

said at least one bite tooth is formed in such a manner that an angle between a line perpendicular to a row of said cut teeth and a first surface contour line of said at least one bite tooth is smaller than an angle between a second surface contour line of said at least one bite tooth and said perpendicular line, and said at least one bite tooth has a smaller pitch than pitches of said cut teeth.

2. A printer having a roll paper cutting apparatus, said roll paper cutting apparatus comprising:

a paper cutter having a cutting surface;

at least one bite tooth, having a first geometric shape, disposed on at least one end portion of said cutting surface; and a plurality of cut teeth, each of said cut teeth having a second geometric shape which is different from said first geometric shape, said plurality of cut teeth being disposed only on a region of said cutting surface distinct from said at least one end portion on which said at least one bite tooth is disposed, none of said cut teeth being located on said at least one end portion of said cutting surface, said at least one bite tooth and said cut teeth being located along a straight line, wherein:

said at least one bite tooth is formed in such a manner that an angle between a line perpendicular to a row of said cut teeth and a first surface contour line of said at least one bite tooth is smaller than an angle between a second surface contour line of said at least one bite tooth and said perpendicular line, and said at least one bite tooth has a smaller pitch than pitches of said cut teeth.

* * * * *